United States Patent [19]

Schloemann

[11] 4,127,477

[45] Nov. 28, 1978

[54] HIGH CAPACITY MATERIALS SEPARATION APPARATUS

[75] Inventor: Ernst F. R. A. Schloemann, Weston, Mass.

[73] Assignee: Raytheon Company, Lexington, Mass.

[21] Appl. No.: 748,843

[22] Filed: Dec. 9, 1976

Related U.S. Application Data

[63] Continuation-in-part of Ser. No. 632,609, Nov. 17, 1975, abandoned.

[51] Int. Cl.[2] ..... B03C 1/30

[52] U.S. Cl. ..... 209/39; 209/212; 209/138

[58] Field of Search ..... 209/223 A, 219, 218, 209/212, 39, 40, 231, 213, 138, 139, 143; 226/23

[56] References Cited

U.S. PATENT DOCUMENTS

| | | | |
|---|---|---|---|
| 213,598 | 3/1879 | Wheeler | 209/223 A |
| 278,976 | 6/1883 | Viger | 209/223 A X |
| 662,413 | 11/1900 | Gates | 209/223 A |
| 1,945,411 | 6/1934 | Armstrong | 226/23 X |
| 2,210,925 | 8/1940 | Hill | 226/23 |
| 2,346,265 | 4/1944 | Kjatz | 226/23 X |
| 2,484,473 | 10/1949 | Staege | 226/23 X |
| 2,535,719 | 12/1950 | Blind | 209/219 |
| 2,698,982 | 1/1955 | Smith | 226/23 X |
| 2,874,839 | 12/1959 | Ropers | 209/232 |
| 3,013,513 | 12/1961 | Judelson | 226/23 U X |
| 3,119,535 | 1/1964 | Hoffman | 226/23 |
| 3,133,015 | 5/1964 | Cavanagh | 209/39 |
| 3,504,835 | 4/1970 | Callan | 226/23 |
| 3,716,946 | 2/1973 | Graf | 209/214 X |
| 3,824,516 | 7/1974 | Benowitz | 209/212 X |
| 4,003,830 | 1/1977 | Schloemann | 209/212 |

FOREIGN PATENT DOCUMENTS

| | | | |
|---|---|---|---|
| 19,964 | 3/1965 | Japan | 209/231 |

*Primary Examiner*—Robert Halper

*Attorney, Agent, or Firm*—Harold A. Murphy; Joseph D. Pannone; John T. Meaney

[57] ABSTRACT

A high capacity materials separation apparatus including a conductive metals segregator in the form of a magnetic ramp for receiving commingled materials from an air classifier, the air classifier comprising means for separating materials into heavy and light fractions, and means for maintaining positive air pressure within the classifier for propelling the nonmagnetic heavy fractions at accelerated velocity from the classifier so as to achieve high capacity separation of conductive materials at the ramp.

4 Claims, 9 Drawing Figures

HIGH CAPACITY MATERIALS SEPARATION APPARATUS

CROSS-REFERENCE TO RELATED APPLICATIONS

This is a continuation-in-part of application Ser. No. 632,609, now abandoned filed Nov. 17, 1975.

BACKGROUND OF THE INVENTION

A materials separator for separating nonferromagnetic conductors from commingled nonferromagnetic materials is shown and described in U.S. Pat. No. 4,003,830, issued Jan. 18, 1977, and assigned to the present assignee. This separator is described as a ramp having embedded in its surface steady-state magnetic means in the form of strips of magnets arranged in alternating polarity at an angle to the path of commingled materials flowing down the ramp. The magnets establish a periodic series of oppositely directed static magnetic fields which induce eddy currents in conductors as they pass down the ramp. Thus, conductive materials are deflected by the magnets and thus are separated from nonconductive materials in the stream of commingled materials flowing down the ramp surface. Nonconductive materials will pass downwardly as an undeflected stream, while conductors will be deflected laterally into a separate stream to be subsequently collected as segregated conductive materials.

The inclination of the ramp may be adjusted to a desired angle to control the sliding velocity of the materials flowing down the ramp surface. However, certain limitations exist with respect to separation efficiency when the rate at which materials are fed to the ramp exceeds about 0.5 tons per hour. Since some processing plants require rates of the order of as much as 10 tons per hour, it becomes highly desirable to increase the capacity of the metal separator.

One method for achieving this is described in said U.S. Pat. No. 4,003,830 and comprises the provision of a dual ramp structure embodying a pair of juxtaposed magnetic arrays in the ramp surface.

A second method of obtaining greater capacity is to provide several basic metal separators in parallel and/or in series as described in U.S. Pat. No. 4,029,573, issued June 14, 1977, and also assigned to the present assignee, which separators may be either single or dual, as desired. It is also highly desirable to provide magnetic preseparators for removing magnetic materials from the materials being fed to the ramp-type separators.

It has been found by theoretical analysis and confirmed by experimental observation that the deflection of a metallic particle from the flowing stream of commingled particles is substantially independent of the initial velocity with which the particle enters the magnetic portion of the ramp.

The reason why the performance of the metal separator decreases with increasing feed rate is the interference between different particles. The higher the feed rate, the more likely are collisions between the particles on the ramp. These collisions tend to deflect some of the particles from the courses they would take if they did not interact with other particles. Since the frequency of collisions depends mostly upon the number of particles per unit area of the ramp surface and not upon the initial velocity, it therefore becomes advantageous to operate with a high initial velocity in order to achieve a high feed rate.

In the structure described in the aforementioned patent applications a moderately high velocity is achieved by means of a chute which guides the feed material under gravitational forces to the magnetic portion of the ramp. Attempts to increase the initial velocity by increasing the length of the chute have not proved successful in practice because air drag limits the velocity achievable by lengthening the chute.

Another disadvantage with prior art devices is that magnetic materials are often included in the commingled materials being fed to the separator ramp. These magnetic materials will adhere to and become lodged on the ramp surface and will cause other nonmagnetic particles to become undesirably scattered by collisions with the magnetic materials, thus degrading the efficiency of the separator.

SUMMARY OF THE INVENTION

The above and other disadvantages of known separators of the character described are overcome or eliminated by the present invention wherein the ramp is fed with commingled materials from an air classifier through which air is simultaneously forced at a velocity greater than the normal gravitational velocity of the materials. This enables the flow of materials to be accelerated before the materials reach the magnetic portion of the ramp so that the initial velocity of the materials at the ramp is considerably higher than when chutes or other prior art feeders are used.

A further advantage of the present invention is that the ramp-type metal separator is easily integrated with the last stage of an air classifier which separates light and heavy fractions, and the means for increasing the velocity of the materials at the ramp is integrated into the air classifier, thus increasing the rate of flow of materials out of the classifier. This consequently increases the capacity of the apparatus which is not achieved alone by increasing the velocity of the materials flowing over the ramp.

In accordance with this invention also there is provided an air classifier which includes a magnetic preseparator for removal of residual magnetic material, and a vibrating feeder which regulates the flow or distribution of feed material into the closed pipe to be directed by high velocity air flow from the air classifier to the ramp separator. The complete air classifier, magnetic preseparator and vibrating feed structures are housed in an enclosure containing a plurality of baffles. Commingled materials enter the enclosure at the top and the baffles intercept the fall of the materials. Air is circulated through the classifier in the upward direction with positive pressure being maintained at the lower end of the enclosure in order to force air through the pipe leading to the ramp separator. Light fractions are removed by entrainment in the air stream out the upper end of the enclosure through a pipe in which negative pressure is maintained. The heavy magnetic material is removed at a point below the lowest baffle and above the vibrating feeder, with the heavy nonmagnetic material being forcefully urged by air into the vibrating feeder and then into the entrance of the pipe leading to the separator ramp.

In another embodiment of the invention, the separation of magnetic materials from nonmagnetic materials occurs at the separator ramp which is provided for this purpose with a laterally moving belt which constitutes the ramp surface down which the commingled materials slide. The belt prevents magnetic materials from adhering in a fixed position to the ramp and consequent interference with the flow of nonmagnetic materials.

In this self-cleaning structure, it will be apparent that wet or sticky items also will be quickly removed by the belt and thus will not be allowed to interfere with the flow of other materials down the ramp. Additionally, composite items, that is, items containing a combination of materials such as nails within wood, for example, will be efficiently separated and removed.

In this embodiment means is also disclosed for maintaining the moving belt at a desired position on a rotating pulley with high accuracy and reliability.

BRIEF DESCRIPTION OF THE DRAWINGS

The above and other objectives and advantages of the invention will become apparent from the following description taken in connection with the accompanying drawings, wherein.

DESCRIPTION OF THE PREFERRED EMBODIMENTS

Figure 1:
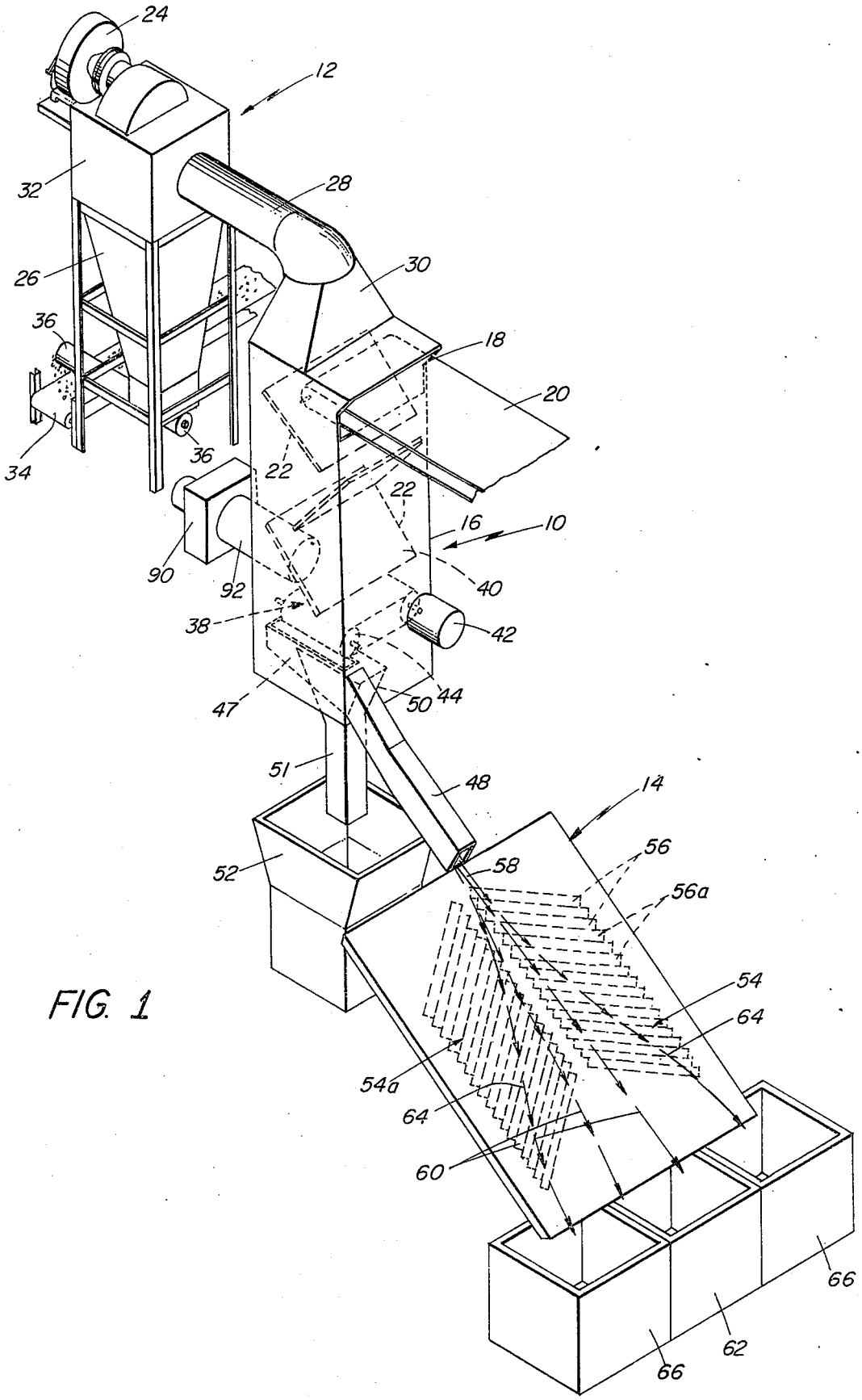
FIG. 1 is an isometric view of materials separation apparatus embodying the invention.
Figure 2:
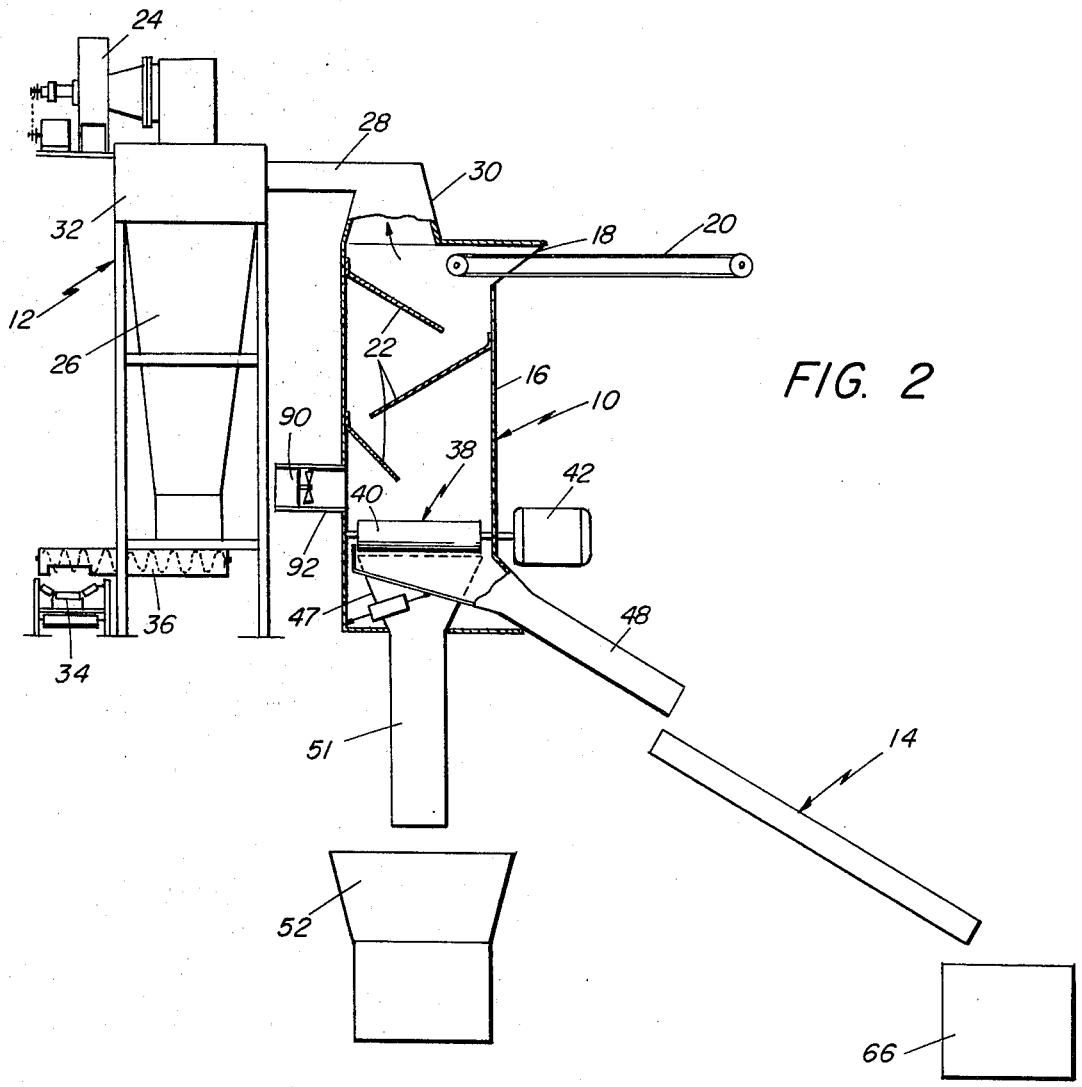
FIG. 2 is a side elevational view partly in vertical section of the apparatus shown in FIG. 1.

Referring more particularly to the drawings wherein like characters of reference designate like parts throughout the several views, the invention as shown in FIG. 1 comprises the combination of an air classifier 10 which includes means for separating materials into light and heavy fractions and means for separating magnetic materials from the separated heavy fractions, collecting means 12 for receiving light fractions from the air classifier, and ramp-type metal separating means 14 for receiving nonmagnetic heavy materials from the air classifier 10 and magnetically separating conductive and nonconductive constituents as the commingled heavy materials slide down the ramp.

The air classifier 10 comprises an upright enclosure 16 having an entrance opening 18 at or near its upper end into which extends one end of a conveyor 20 by which unseparated commingled materials may be deposited in the enclosure. The conveyor 20 may be a belt conveyor as shown or may be a screw conveyor, chute, or other feed device, if desired.

Within the enclosure are a number of vertically spaced downwardly angled baffle plates 22 which intercept the commingled materials falling from the adjacent end of the conveyor 20. The heavy materials will cascade downwardly from one plate to another toward the bottom of the enclosure. Simultaneously therewith a stream of air is directed upwardly through the enclosure by means of a blower 24 which communicates with the interior of the air classifier enclosure 16 at the top thereof via a collector such as cyclone 26 and pipe 28. By this means the light materials will be entrained in the upwardly directed air stream within the classifier enclosure 16 and will be carried out the top of the classifier through pipe 28 into the collector 26. Cascading of the commingled materials within the enclosure will assist in segregation of the light materials from the heavy materials and aid in the entrainment of the light materials in the air stream. The heavy materials will not be supported by the air stream and will continue downwardly.

The pipe 28 may be attached to the top of the air classifier enclosure at one end by means such as a hood 30, and is attached at its other end to a plenum 32 forming a part of the cyclone collector 12. The distribution and circulation of air and light materials within the collector 12 are such that the light materials will fall into the bottom of the collector while the air is removed from the top thereof by the blower 24, as is well known. The light materials or fractions in the bottom of the collector may be removed at any time to a conveyor 34 by means such as a feed screw device 36 or the like for subsequent disposal or further processing.

Figure 3:
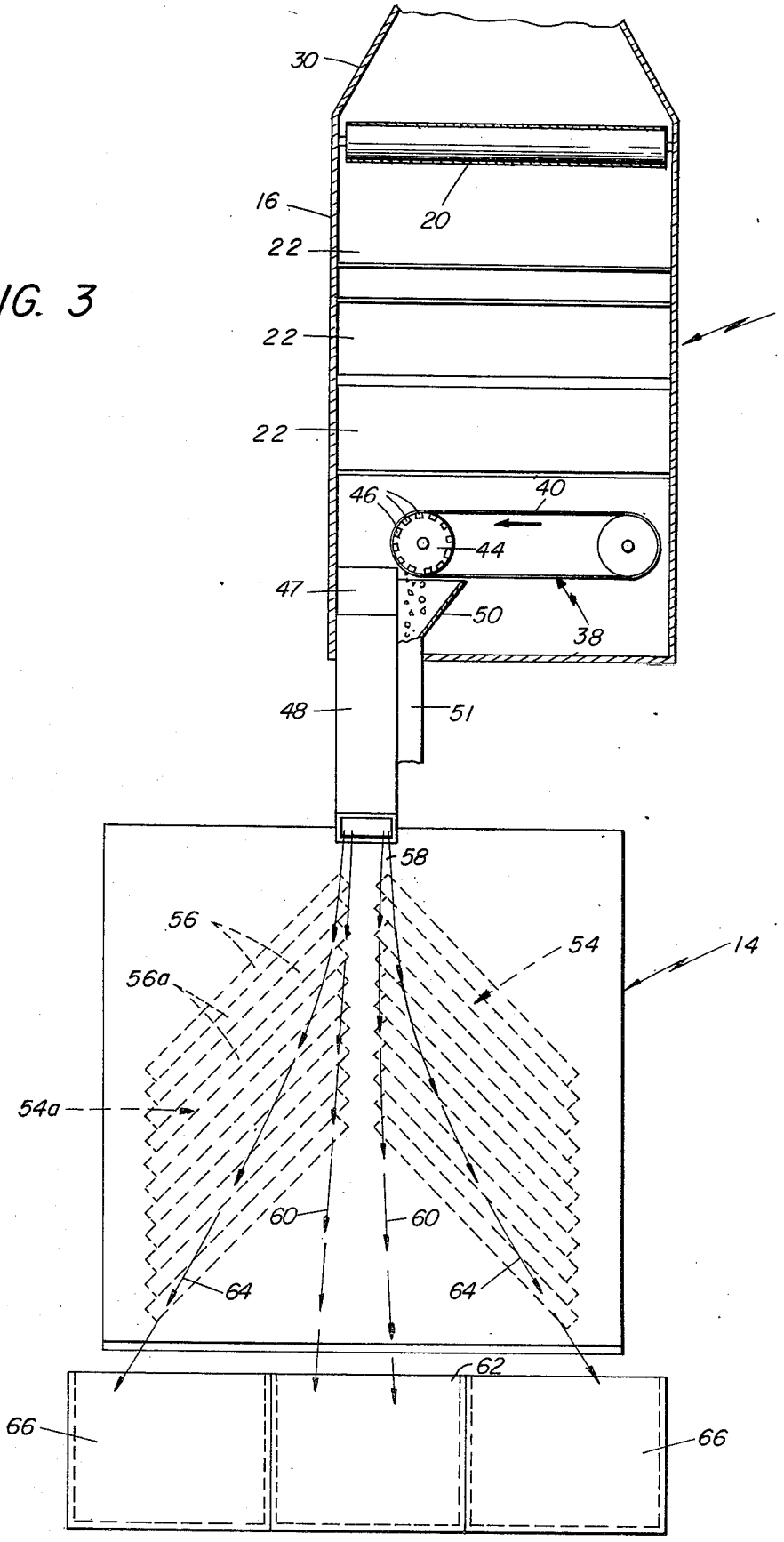
FIG. 3 is a front elevational view partly in vertical section of the air classifier and metal separator ramp portions of the apparatus shown in FIG. 1.

In accordance with this invention, the air classifier includes as a part thereof a magnetic preseparator 38 for removing magnetic materials from the heavy fractions within the lower portion of the classifier enclosure 16. The magnetic preseparator 38 comprises a belt conveyor 40 driven by a motor 42 beneath the lowest baffle plate 22. Heavy materials falling off the lowest baffle plate 22 will drop onto the conveyor belt and will be moved by the belt in the direction of the arrow (FIG. 3). The adjacent baffle plate 22 may be provided with suitable guides or shields (not shown) to insure that all material from the plate will fall onto the conveyor.

One end of the conveyor 40 comprises a drum 44 upon which the belt is located and which has a plurality of permanent magnets 46 embedded in its outer surface as shown in FIG. 3. Thus, as the belt moves in the direction of the arrow, all heavy materials on it will be carried over the drum 44 and magnets 46. Nonmagnetic materials will be unaffected by the magnets and will drop off the belt into a vibratory hopper 47 at one end of a closed pipe 48. Magnetic materials will be attracted to the magnets 46 as they are moved into the magnetic fields by the conveyor belt. These magnetic materials therefore will not drop off the end of the conveyor into the hopper 47 but will instead continue to be carried by the belt around the drum 44 until they are moved out of the attracting magnetic fields, at which time they are then released to fall into a hopper 50 on the adjacent end of a pipe or chute 51.

The magnetic materials which are thus removed from the heavy materials are collected by a bin or conveyor 52 or other means for subsequent disposal or further processing. However, the nonmagnetic materials upon passing from the vibratory hopper into the pipe or conduit 48 will be exhausted onto the upper end portion of the separator ramp 14.

The separator ramp 14, as fully described in aforementioned U.S. Pat. No. 4,003,830, includes a panel in the surface of which are embedded a longitudinally extending pair of juxtaposed magnet arrays 54 and **54*a*. The magnet arrays are covered by a relatively thin layer of low friction nonmagnetic material such as sheet stainless steel upon which the commingled heavy materials slide after leaving the adjacent end of pipe 48. Ramp 14** may be mounted in any suitable manner for adjustment of the ramp angle to a selected inclined plane, as desired.

Each magnet array 54 and 54*a* comprises a parallel series of alternating oppositely polarized magnets 56 and 56*a*, which extend transversely of the inclined plane at a substantially uniform angle with respect to the longitudinal centerline of the ramp. Each of the respective magnet arrays establishes a spatially alternating series of oppositely directed static magnetic fields which, in combination, form a herringbone pattern on the slope of the inclined ramp. As a result, one longitudinal half of the ramp structure constitutes a mirror image of the other half. Thus, it can be seen that the dual array ramp structure has a materials handling capacity double that of a single array ramp.

Pipe 48 is disposed to normally direct a stream 58 of comingled nonferromagnetic items or particles under the influence of gravitational forces onto the ramp surface near the upper end thereof. In a dual magnet structure there may be provided a stream splitter (not shown) to divide the stream into two spaced streamlets directed onto respective magnet arrays. Items in each streamlet normally flow by gravitation force down the inclined slope of the respective magnet array, and pass sequentially through the associated alternating series of oppositely directed static magnetic fields.

During this flow of materials down the ramp nonconductive items, such as 60, will not have eddy currents induced in them and, therefore, they will follow a generally rectilinear path down the slope and will fall off the lower end of the ramp into a centrally disposed collector such as bin 62.

However, conductive items 64 will have eddy currents induced in them and consequently are deflected laterally while continuing to travel down the slope of the ramp. Such conductive items will eventually drop off the lower end of the ramp into a bin 66 or the like.

Since conductive items will be deflected laterally, the bins 66 are disposed on opposite sides of bin 62. Bin 62 is disposed substantially in alignment with the longitudinal central portion of the ramp and will consequently receive the nonconductive items 60 which may be referred to as "tailings." The two bins 66 on opposite sides of bin 62 are substantially aligned with respective longitudinal outer marginal portions of the ramp and will consequently receive the conductive items which may be referred to as "headings."

As previously mentioned, the angle of inclination of the ramp may be adjusted to an optimum for achieving maximum deflection of items made of a selected material such as aluminum, for example, while maintaining a smooth flow of nonferromagnetic materials down the ramp. Thus, items of the selected material may be deflected greater lateral distances than other conductive items. Therefore, additional bins may be provided for such items.

As has been pointed out hereinbefore, one method of increasing the capacity of a ramp-type conductive materials separator is to deploy several of the separators in parallel, together with the use of magnetic preseparators for removing all residual magnetic materials from the materials being supplied to the separators.

In accordance with the present invention greater capacity may be achieved by feeding the materials from an air classifier to a ramp at a relatively high velocity, as will be described. This method will be described as applied to a single ramp-type separator but it may be used also in combination with a parallel arrangement of several separator ramps.

It has been found that the deflection of a metallic particle in the stream being fed to the ramp is substantially independent of the initial velocity with which the particle enters the magnetic portion of the ramp. The present invention makes use of this physical fact.

The reason why the performance of the metal separator normally decreases with increasing feed rate is the interference between different particles. The higher the feed rate the more likely are collisions between the particles on the ramp. These collisions deflect the particles from their "proper" course, i.e., the course they would take if they did not interact with other particles. Since the frequency of collisions depends mostly upon the number of particles per unit area of the ramp surface and not upon the initial velocity, it is therefore advantageous to operate with a high initial velocity in order to achieve a high feed rate. In the prior known separator described in the aforementioned application gravitational velocity is achieved by means of a chute which accelerates the feed material before it enters the magnetic portion of the ramp. It may appear that in order to increase the initial velocity one need only increase the length of the chute. This would be a correct conclusion if the particle motion were not affected by air drag. In practice, however, air drag limits the velocity achievable by lengthening the chute.

The present invention eliminates the detrimental effect of air drag by replacing the open chute with the closed pipe 48 and forcing air through this pipe at a velocity equal to or greater than the particle velocity. A further advantage of the invention is that the metal separator can easily be integrated with the last stage of the air classifier 10 which separates the light fraction (paper, light plastics, etc.) from the heavy fraction (wood, heavy plastics, non-ferrous metals, etc.). Such air velocity is achieved by means for maintaining positive air pressure at the lower outlet end of the air classifier enclosure 16 in order to forcefully expel air through the pipe 48 leading to the separator ramp 14. A negative air pressure is maintained in the upper end of the enclosure 16 and in the pipe 28 through which the light fraction is removed. In fact, air pressure at the top of the enclosure should be approximately equal to atmospheric pressure to make it easier to introduce unseparated material into the air classifier.

Positive pressure at the lower end of the enclosure may be achieved by a fan or blower 90 which is mounted on the outside of the enclosure 16 and communicates with the interior of the enclosure by pipe 92. In this way material is forcefully introduced via pipe 48 to the ramp 14.

Figure 4:
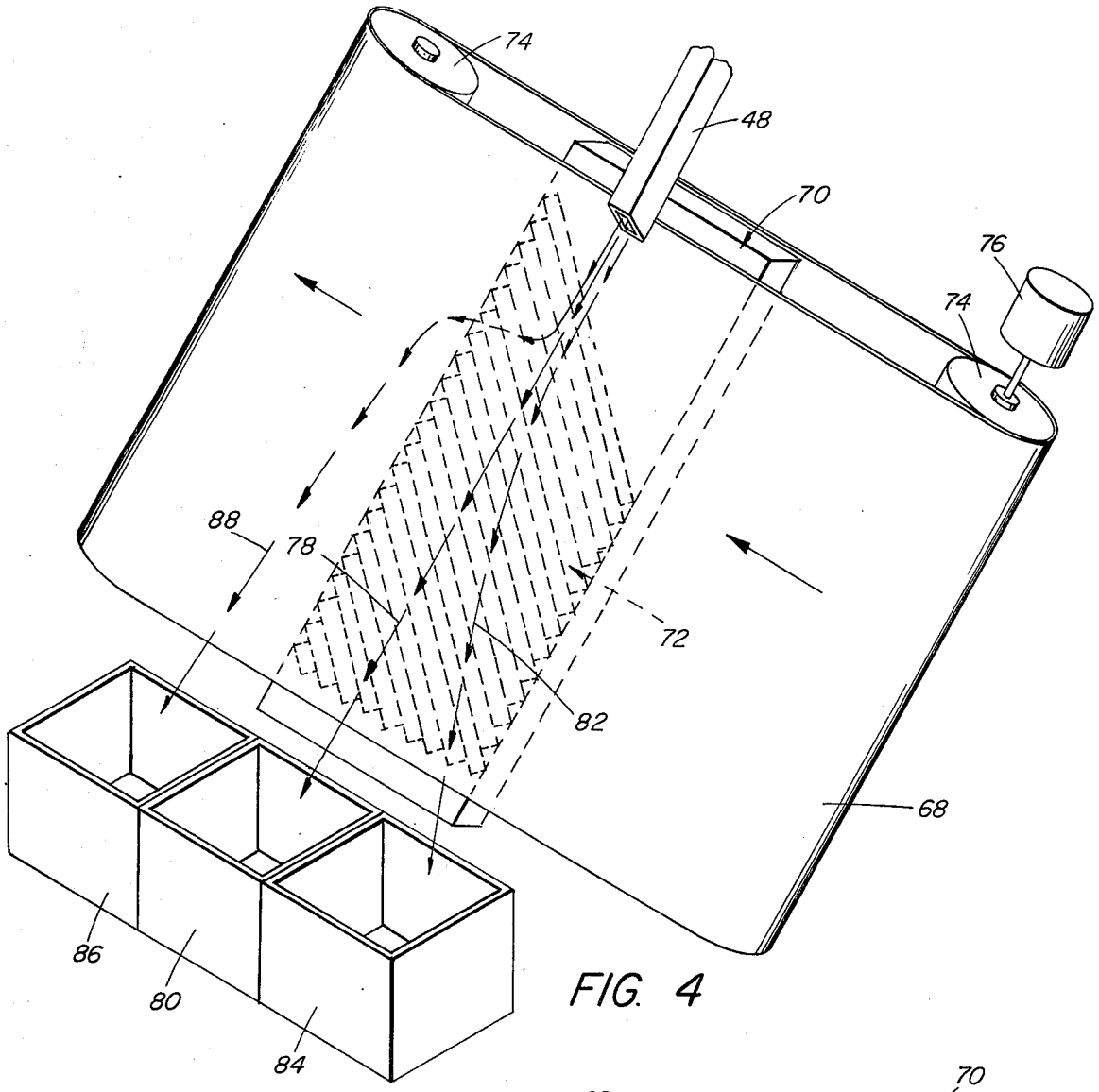
FIG. 4 is a fragmentary isometric view of a separator ramp with a moving belt for removing magnetic materials.
Figure 5:
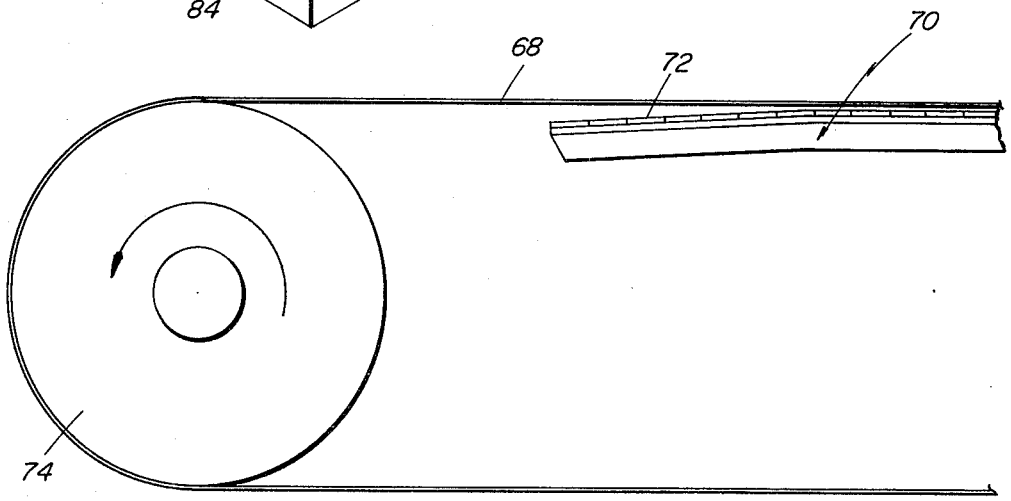
FIG. 5 is an enlarged fragmentary view of the end of the ramp and associated belt.
Figure 6:
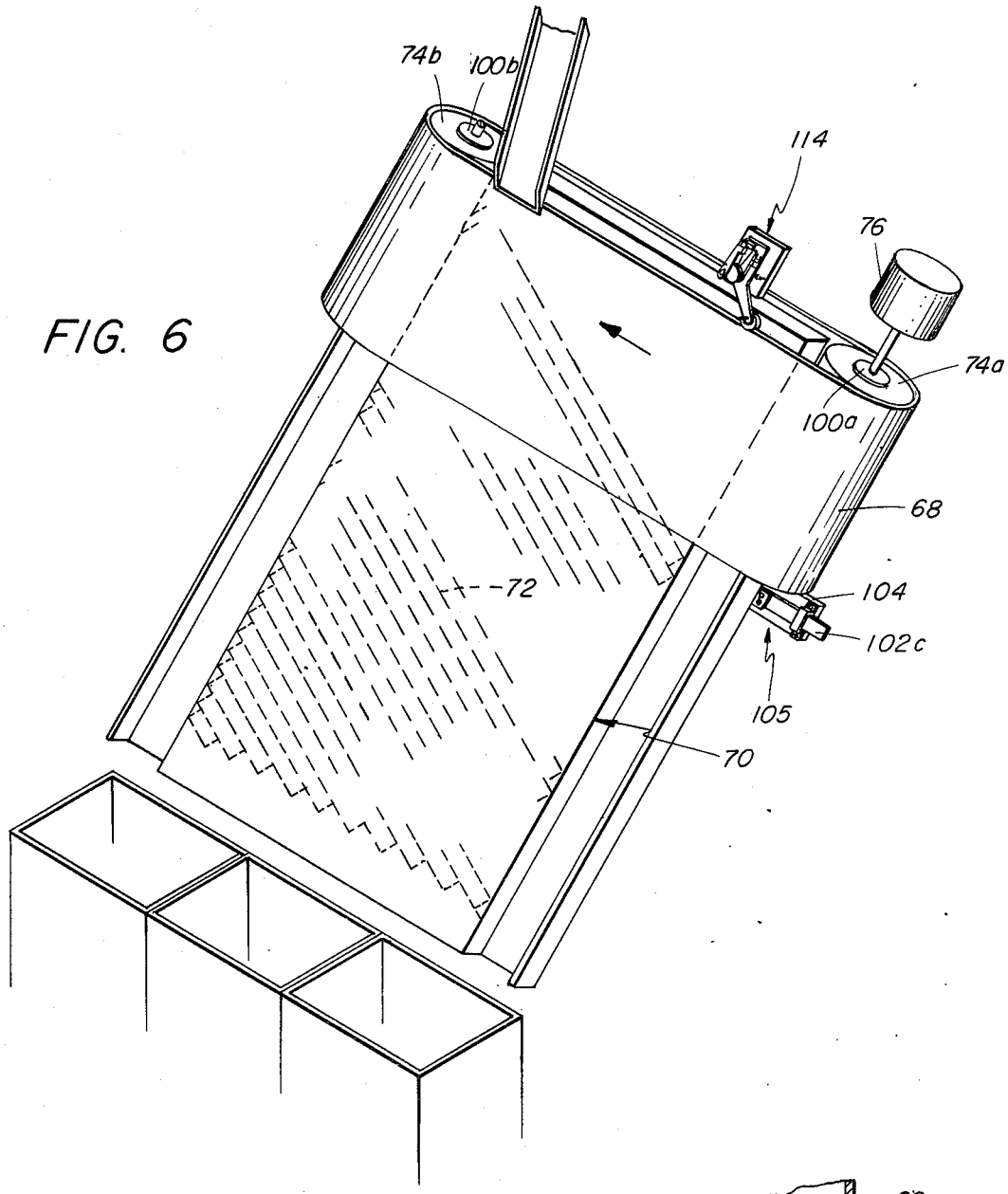
FIG. 6 is an isometric view of a separator ramp with moving belt and belt control mechanism.
Figure 7:
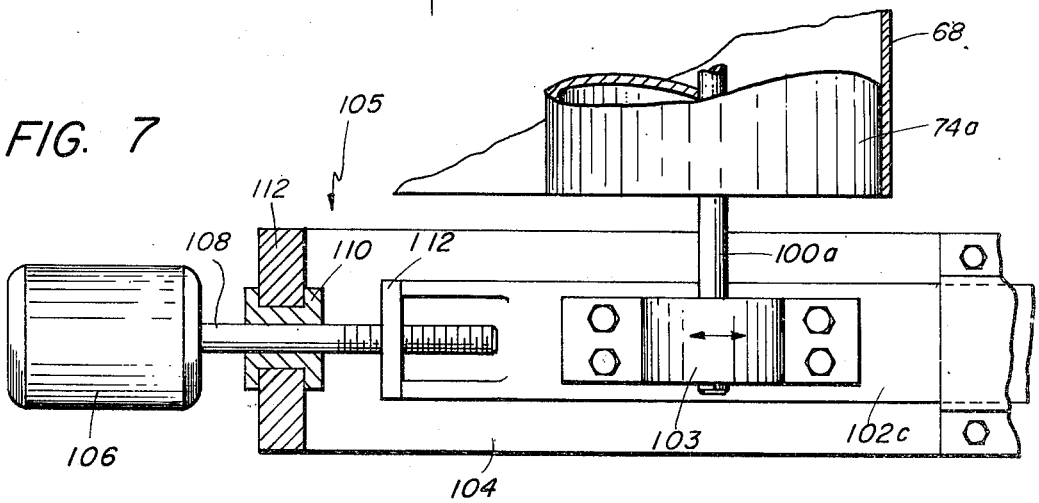
FIG. 7 is an enlarged fragmentary elevational view of the belt repositioner device.
Figure 8:
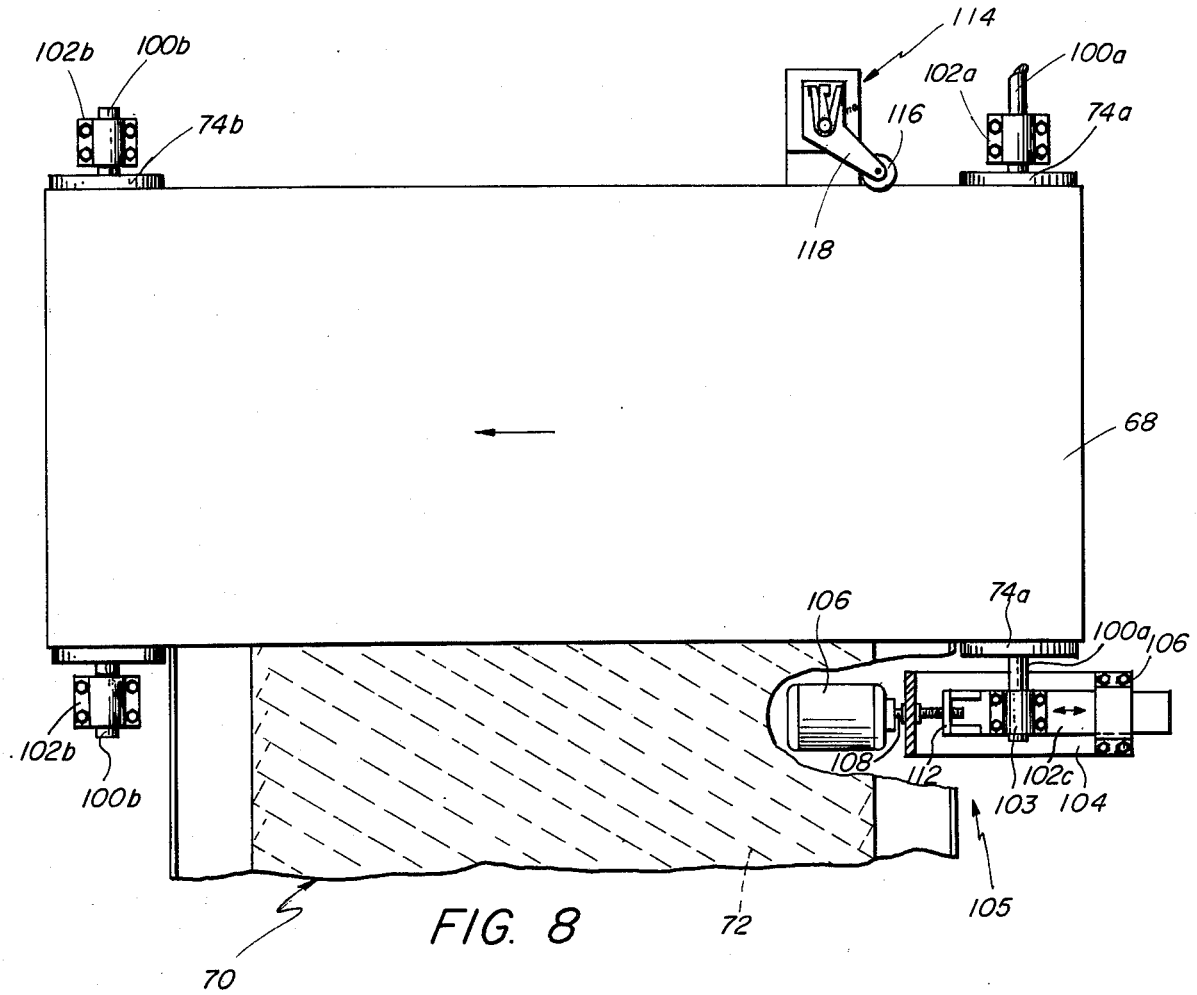
FIG. 8 is an elevational view of the belt mechanism and repositioner.

FIGS. 4 and 5 depict an alternate form of separator means which may be used in the apparatus of FIG. 1 when no magnetic preseparator is used. As pointed out hereinbefore, the magnetic preseparator 38 was included in the lower portion of the air classifier 10 to separate magnetic items and particles from the heavy materials being fed to the separator ramp 14. However, in the event such a preseparator is not employed, the magnetic items and particles will adhere to the ramp surface and will obstruct, deflect, or otherwise impede the gravitational flow of nonmagnetic materials down the ramp.

In order to overcome this drawback the ramp separator is provided with its own self-cleaning means whereby metallic items and particles are removed from the supply of heavy materials flowing down the ramp. This is achieved by means of a moving belt 68 which closely overlies the upper sloped surface of the ramp 70 as seen in FIGS. 4 and 5. The ramp 70 in this case has a single magnet array 72 across which the belt 68 is moved transversely. The belt preferably is of a continuous type wound over two drums or rollers 74, one opposite each longitudinal side edge of the ramp and with their axes disposed substantially parallel therewith. One drum 74 is driven by a motor 76 to effect movement of the belt 68 transversely over the ramp surface.

In operation, heavy materials will be emitted from the adjacent end of pipe 48 onto a portion of the belt overlying the ramp. These heavy materials will slide by gravitational force down the belt at some velocity and will pass through the magnetic fields of the magnets. Nonconductive nonmagnetic materials will drop down path 78 directly to a bin 80 without any substantial deviation from a straight path except such as may be caused by some slight frictional engagement with the moving belt surface. Conductive items will have eddy currents induced in them and will consequently be deflected into a path 82, as described in connection with the apparatus of FIG. 3, and will be deposited in a separate bin 84 adjacent the lower end of the ramp.

Magnetic items which are included in the materials emanating from the pipe 48 upon entering the magnetic fields of the magnets will tend to adhere to the magnets and thus be prevented from continuing to the bottom of the ramp. These items would of course obstruct and interfere with the downward flow of nonmagnetic items. However, movement of the belt 68 transversely of the ramp 70 and magnet array 72 will cause the magnetic items to be quickly carried off the side of the ramp whereupon they will fall into a third collection bin 86 along path 88. If a magnetic item, or particle is strongly magnetic, its downward movement is arrested very soon after it enters the magnetized portion of the ramp surface. If it is weakly magnetic it will tend to slide a greater distance before its motion is arrested.

In order to conveniently remove the magnetic particles from the belt surface it is necessary to reduce the magnetic force of attraction rather gradually as an item is carried across the ramp by the belt. Tests have shown that with the magnet array used in the simple ramp separator the magnetic items will be transported across the ramp face only as far as the edge of the array, but then remain there without sliding down. This difficulty can be overcome by designing the magnet array in such a way that the magnetic force of attraction is reduced gradually rather than abruptly at the edge of the array. For this purpose the strength of the magnets, their remanent magnetization, can be tapered or the magnets can be arranged such that they gradually recede from the belt. The latter option is illustrated in FIG. 5, which shows a cross section through part of the ramp structure together with the belt and one of the pulleys which transport the belt. As shown, the flat plate which carries the magnet array is slightly inclined back from the inner belt surface near the edge of the array. Bending the plate by an angle $\phi$ of approximately three degrees has been found to result in satisfactory performance whereby the magnetic items become easily separated from the ramp.

Thus, both conductive items and magnetic items can be efficiently separated from commingled materials by the ramp-type separator shown and described.

In either embodiment of the invention materials are fed from the air classifier to the separator ramp at relatively high velocity whereby increased processing capacity of the separator is achieved.

In further accordance with this invention there is shown in FIGS. 6–9 a servocontrol system which makes it possible to maintain the moving belt 68 at a desired position on a pair of rotating pulleys **74*a* and 74*b* with high accuracy and reliability and without damaging or deforming the belt. The pulleys or drums 74*a* and 74*b* are mounted on shafts 100*a* and 100*b* respectively with one of the shafts being driven by a motor 76 as shown in FIG. 4. End portions of shaft 100*b* are rotatably supported on a suitable base by fixedly located pillow blocks 102*b*. One end of shaft 100*a* is similarly located on a fixed pillow block 102*a* as by a bracket 103. However, the opposite end of shaft 100*a* is rotatably positioned within a movable pillow block 102*c* (FIGS. 7 and 8), which comprises a part of a belt repositioner 105**.

Block **102*c* is slidable upon a support 104 which is conveniently mounted beneath the edge of ramp 70 and is slidably retained on the support 104 as by bracket 106. It will be apparent that when the block 102*c* moves laterally, the adjacent end of the shaft 100*a* will also move with it. This will cause similar movement of the adjacent end of the pulley 74*a*, resulting in a tightening or loosening of the adjacent side portion of the belt 68 on the pulley 74*a***.

The means for moving the pillow block **102*c* on the support 104 comprises a reversible motor 106 having projecting from one end a threaded drive shaft 108 which is rotatably mounted as by a bushing 110 in an upright portion 112 of the support 104. The shaft 108 is threaded into a portion 112 of the pillow block 102*c* and thus moves the pillow block upon being rotated by the motor, the block being movable in a selected direction depending upon the direction of rotation of the motor. Such movement of the pillow block 102*c* and consequent movement of the shaft 100*a* and pulley 74*a* will thus adjust the longitudinal axis of the pulley 74*a*** and will consequently adjust the relationship of the belt on the pulley, causing the belt to adjust itself transversely along the pulley as it moves.

The above-described belt repositioner is adapted to be operated to adjust or reposition the belt in response to detection by a sensor 114 (FIGS. 6,8, and 9) of improper belt position. The sensor 114 senses the position of the belt 68 by means of a roller or spool 116 which is carried by one end of a crank arm 118. The roller is gently pressed against the adjacent edge of the belt by a spring 120 which connects the crank arm 118 to a suitable fixed base 122. The crank arm 118 is rotatable upon the base 122 about a vertical post or spindle 124 which is anchored to the base at its lower end.

The end portion of the crank arm 118 opposite the roller 116 carries a pair of spaced switches 126 and 128 which are each individually connected to the reversible motor 106 so as to drive the motor in a selected direction depending upon which switch is operated. For example, in the event that the belt 68 has migrated too close to the sensor 114, as detected by the roller 116, the crank arm 118 will rotate about post 124 and will consequently move switch 128 with it.

Each switch 126 and 128 has a respective actuator or lever **126*a* and 128*a* projecting upwardly through a space between two control arms 130 and 132. Arms 130 and 132 overlap at one end and the overlapping ends are rotatably mounted on the post 124 above the crank arm 118. The arms are adjustably connected together for common movement by slot and screw device 133**.

Movement of switch 128 with crank arm 118 will cause the switch lever 128*a* to engage the inner edge of arm 132. Since the arms 130 and 132 are held against a pedestal 134 by the tension of a spring 136, the switch lever 128*a* will be flexed sufficiently to operate the switch 128 and thus cause the motor 106 to revolve in a direction which will draw the pillow block inwardly. This will consequently decrease the tension on the belt, allowing it to migrate toward the repositioner 105.

If the repositioner is not immediately effective to correct belt position, the crank arm 118 is rotated still farther. The body of switch 128 then comes into contact with a downwardly turned flap 138 on control arm 132. Continued movement of crank arm then will cause the switch body to forcibly move both control arms 130–132 as a unit by overcoming the friction between the control arms and the pedestal. Such movement of the control arms through flap 138 prevents excessive bending of the switch levers and possible resultant damage.

Figure 9:
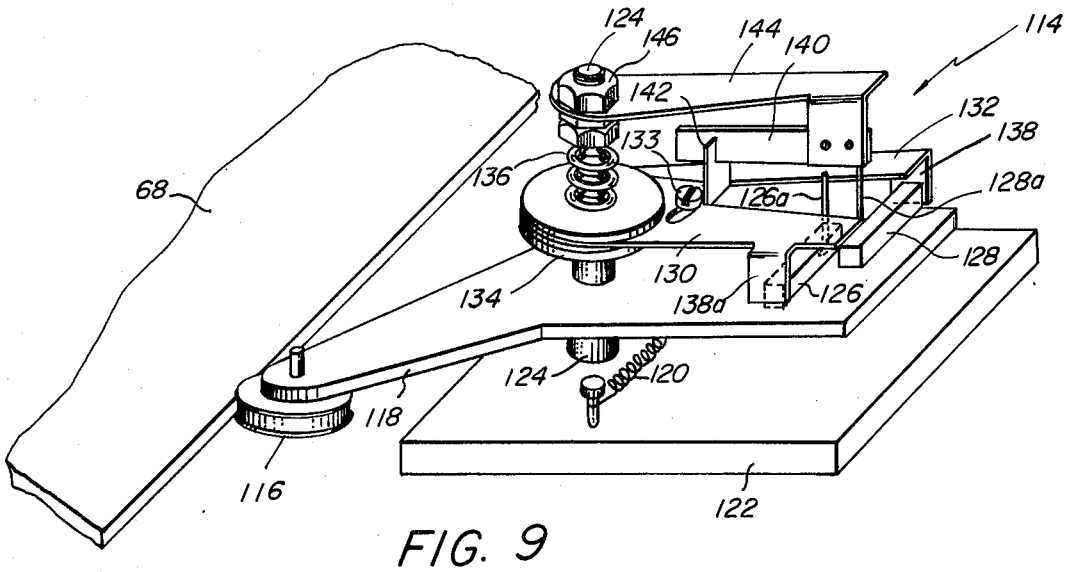
FIG. 9 is an isometric view of the belt sensing device.

When migratory motion of the belt begins to occur in the opposite direction, the parts of the sensor will return to their initial positions. However, should the crank arm 118 continue to move the control arms 130–132 still further, this movement will be accomplished against the tension of an additional spring, this being a leaf spring 140 which is adapted to reside within a slot in the upper end of an upturned flap 142 carried by one of the control arms 130–132 (FIG. 9). The opposite end of the leaf spring 142 is fixed to a tether arm 144 secured to the upper end of post 124 between locking nuts 146. Thus, when the belt tends to return to its normal correct position, coil spring 120 returns the crank arm 118 and leaf spring 140 returns the control arms 130–132.

When the belt 68 migrates in a direction toward the repositioner 105, the crank arm roller 116 will move downwardly to maintain its engagement with the edge of the belt under urging of spring 120. This will swing contact arms 130–132 so that lever 126*a* will cause operation of switch 126, thus causing the reversible motor 106 to operate in a manner to push the pillow block outwardly, increasing tension between the adjacent edge of belt 68 and pulley 74*a*. This will permit the belt to return to the desired position.

Continued downward movement of the roller 116 will cause consequent continued rotation of the crank arm 118 which will move switch body 126 against flap 138*a* on control arm 130. This will move the assembled control arm unit against the tensions of coil spring 136 and leaf spring 140. Then upon movement of the belt toward its desired position, the springs 120 and 140 will return the sensor parts to their initial positions.

In this way a belt is automatically retained in a desired position on its pulley without being damaged such as can occur by trying to do this by prior art methods such as, for example, by exerting a force against at least one edge of the belt. Furthermore, crowning the center of the belt is difficult and undesirable in the present application.

What is claimed is:

1. Materials separating apparatus for separating items of electrically conductive material from a supply of commingled materials comprising the combination of:

a vertical air classifier for receiving commingled light and heavy materials;

means for directing flow air upwardly through said classifier for entrainment and removal therein of light fractions, and for deposit of the remaining heavy fractions in the bottom of the classifier;

an inclined ramp located adjacent the lower end of said classifier and containing immovable steady-state magnetic means for establishing an alternating series of oppositely directed parallel magnetic fields transversely at an angle oblique to the length of the ramp;

guide means connected to the classifier for receiving the commingled heavy materials from the classifier and forming them into a stream and directing said stream at a predetermined rate of flow onto the surface of said ramp adjacent its upper end whereby said heavy materials will flow down the ramp sequentially through the magnetic fields whereupon eddy currents will be induced in electrically conductive items to produce force components which deflect the electrically conductive items out of said stream; and means associated with said classifier for increasing said rate of flow at which commingled heavy materials are removed from the classifier and directed onto said ramp.

2. Apparatus as set forth in claim 1 wherein said guide means is an inclined pipe having one end located to receive heavy commingled materials from the classifier and having its other end disposed adjacent the upper end of the ramp for permitting said heavy commingled materials to slide downwardly onto the surface of the ramp, and blower means is connected with said classifier for increasing the rate of flow of said heavy materials from the classifier.

3. Materials separating apparatus comprising the combination of:

an upright air classifier;

means for depositing commingled light and heavy materials to be separated in one end of the classifier;

means for directing a stream of air at high velocity upwardly through the classifier for entrainment therein and removal of light fractions from the commingled materials and deposit of remaining heavy fractions in the classifier;

magnetic separating means within the classifier for receiving the remaining heavy fractions and separating therefrom magnetic items with the nonmagnetic items being deposited in the lower portion of the classifier;

guide means for receiving the deposited nonmagnetic heavy items and forming them into a stream;

an inclined ramp containing steady-state magnetic means for establishing an alternating series of oppositely directed parallel magnetic fields transversely at an angle oblique to the length of the ramp, said guide means including an angled pipe for permitting said items to slide downwardly at a predetermined rate of flow onto and over the surface of the ramp whereby electrically conductive items will be separated; and means for directing a separate flow of air through the lower portion of the classifier for increasing said rate of flow at which the nonmagnetic heavy materials are removed from the classifier and directed therefrom to said ramp.

4. Apparatus as set forth in claim 3 wherein said last means is a blower.

* * * * *